US012023778B2

(12) United States Patent
Trojan et al.

(10) Patent No.: US 12,023,778 B2
(45) Date of Patent: Jul. 2, 2024

(54) SUBSTRATE CARRIER HEAD AND PROCESSING SYSTEM

(71) Applicant: Axus Technology, LLC, Chandler, AZ (US)

(72) Inventors: Daniel Ray Trojan, Chandler, AZ (US); William Manfred Daschbach, Gilbert, AZ (US)

(73) Assignee: Axus Technology, LLC, Chandler, AZ (US)

( * ) Notice: Subject to any disclaimer, the term of this patent is extended or adjusted under 35 U.S.C. 154(b) by 500 days.

(21) Appl. No.: 17/310,435

(22) PCT Filed: Jan. 30, 2020

(86) PCT No.: PCT/US2020/015837
§ 371 (c)(1),
(2) Date: Aug. 2, 2021

(87) PCT Pub. No.: WO2020/167485
PCT Pub. Date: Aug. 20, 2020

(65) Prior Publication Data

US 2022/0126419 A1 Apr. 28, 2022

Related U.S. Application Data

(60) Provisional application No. 62/805,643, filed on Feb. 14, 2019.

(51) Int. Cl.
*B24B 37/32* (2012.01)

(52) U.S. Cl.
CPC ..... *B24B 37/32* (2013.01)

(58) Field of Classification Search
CPC ..... B24B 37/32; B24B 37/00; B24B 37/27; B24B 37/11; B24B 37/30
See application file for complete search history.

(56) References Cited

U.S. PATENT DOCUMENTS 4,158,935 A * 6/1979 Robert ..... B24B 55/102 451/359
6,056,632 A 5/2000 Mitchel et al.
(Continued)

FOREIGN PATENT DOCUMENTS

EP 0841123 A1 5/1998
EP 0879678 A1 11/1998
(Continued)

OTHER PUBLICATIONS

International Search Report and Written Opinion dated May 20, 2020 for International Application No. PCT/US2020/015837, (9 pages).
(Continued)

*Primary Examiner* — Lee D Wilson
(74) *Attorney, Agent, or Firm* — Knobbe, Martens, Olson & Bear, LLP

(57) ABSTRACT

A substrate carrier head is disclosed. In one aspect, the carrier head includes a carrier body, a substrate retainer, a first resilient membrane and a second resilient membrane. The carrier head can include an inner support plate. The substrate retainer is attached to the carrier body. The substrate retainer includes an aperture configured to receive a substrate. The first resilient membrane includes a first imperforated substrate support portion with a width W1. The second resilient membrane includes a second imperforated substrate support portion with a width W2. The second imperforated substrate support portion is positioned between the first substrate support portion and the carrier body, and is configured to selectively provide a force against at least an inner section of the first imperforated substrate support portion. The inner support plate is fixed relative to the carrier body and includes a support surface configured to support the second imperforated substrate support portion.

20 Claims, 6 Drawing Sheets

(56) References Cited

U.S. PATENT DOCUMENTS

| | | | | |
|---|---|---|---|---|
| 6,361,419 | B1 | 3/2002 | Zuniga et al. | |
| 6,422,927 | B1 | 7/2002 | Zuniga | |
| 6,855,043 | B1 | 2/2005 | Tang et al. | |
| 2002/0094767 | A1 | 7/2002 | Zuniga et al. | |
| 2002/0115397 | A1 | 8/2002 | Kajiwara et al. | |
| 2002/0182996 | A1 | 12/2002 | Zuniga et al. | |
| 2003/0124963 | A1 | 7/2003 | Zuniga et al. | |
| 2004/0067719 | A1 | 4/2004 | Zuniga | |
| 2004/0192173 | A1 | 9/2004 | Zuniga et al. | |
| 2008/0153405 | A1 | 6/2008 | McCutcheon et al. | |
| 2012/0309275 | A1 | 12/2012 | Son | |
| 2018/0311784 | A1 | 11/2018 | Trojan | |
| 2021/0005479 | A1* | 1/2021 | Trojan | H01L 21/3212 |
| 2022/0126419 | A1* | 4/2022 | Trojan | B24B 37/32 |
| 2022/0305618 | A1* | 9/2022 | Trojan | B24B 57/02 |

FOREIGN PATENT DOCUMENTS

| | | | |
|---|---|---|---|
| JP | 2000202762 | A | 7/2000 |
| JP | 2001135602 | | 5/2001 |
| JP | 2004071667 | A | 3/2004 |
| KR | 100647042 | B1 | 11/2006 |

OTHER PUBLICATIONS

European Extended Search Report dated Oct. 6, 2022 for European Application No. 20756338.8, (9 pages).

* cited by examiner

SUBSTRATE CARRIER HEAD AND PROCESSING SYSTEM

INCORPORATION BY REFERENCE TO ANY PRIORITY APPLICATIONS

This application is a utility application claiming the benefit of the earlier filing date of U.S. provisional application Ser. No. 62/805,643 filed Feb. 14, 2019 which is hereby incorporated by reference in its entirety.

BACKGROUND

Field

This disclosure is generally related to substrate processing equipment, and more specifically, to a system and apparatus for improving chemical mechanical planarization (CMP) performance for the planarization of thin films using wafer carriers with at least two resilient membranes.

Description of the Related Technology

During chemical mechanical planarization or polishing (CMP), an abrasive and either acidic or alkalinic slurry is applied via a metering pump or mass-flow-control regulator system onto a rotating polishing pad/platen. A wafer is held by a wafer carrier which is rotated and pressed against a polishing platen for a specified period of time. The wafer is polished or planarized by both abrasion and corrosion during the CMP process. The pressures and forces between the wafer and the carrier during processing may cause wafer breakage or non-uniformity. Thus, there is a need to improve wafer carrier performance to increase CMP efficiency and reduce the cost of manufacturing.

SUMMARY

For purposes of summarizing the disclosure and the advantages achieved over the prior art, certain objects and advantages of the disclosure are described herein. Not all such objects or advantages may be achieved in any particular embodiment. Thus, for example, those skilled in the art will recognize that the invention may be embodied or carried out in a manner that achieves or optimizes one advantage or group of advantages as taught herein without necessarily achieving other objects or advantages as may be taught or suggested herein.

One aspect of the disclosed technology is a substrate carrier head comprising: a carrier body; a substrate retainer attached to the carrier body, the substrate retainer comprising an aperture configured to receive a substrate; a first resilient membrane comprising a first imperforated substrate support portion with a width W1; a second resilient membrane comprising a second imperforated substrate support portion with a width W2, the second imperforated substrate support portion positioned between the first substrate support portion and the carrier body and configured to selectively provide a force against at least an inner section of the first imperforated substrate support portion; and an inner support plate fixed relative to the carrier body and comprising a support surface configured to support a substrate held upon the second imperforated substrate support portion.

According to an embodiment, W1 is greater than W2.

According to an aspect, the substrate carrier head further comprises a single first membrane cavity formed between the first substrate support portion and the carrier body.

According to another aspect, the substrate carrier head further comprises a single second membrane cavity formed between the second substrate support portion and the inner support plate.

According to yet another aspect, the substrate carrier head further comprises an outer support plate configured to support an outer section of the first substrate support portion.

According to still yet another aspect, the outer support plate comprises a central opening configured to surround the second substrate support portion.

According to another aspect, the outer support plate, first membrane, and second membrane are configured such that the second substrate support portion can pass through the central opening.

According to yet another aspect, at least one of the outer support plate and the inner support plate comprise a plurality of holes configured to extend through a thickness of the at least one of the outer support plate and the inner support plate, and to provide fluid communication between at least one of the first cavity and the first substrate support portion and the second cavity and the second substrate support portion.

According to still yet another aspect, the plurality of holes comprises a first plurality of holes extending through the thickness of the outer support plate, and a second plurality of holes extending through the thickness of the inner support plate.

According to another aspect, the second plurality of holes comprises a center hole extending through the center of the inner support plate, wherein the center hole is the same cross-sectional area as at least one of the other plurality of holes.

According to yet another aspect, each of the plurality of holes are round, and the same diameter relative to each other.

According to still yet another aspect, each of the plurality of holes has an area less than about 0.4 in2.

According to another aspect, the second substrate support portion directly contacts at least the inner section of the first substrate support portion.

According to yet another aspect, the substrate carrier head further comprises a bladder configured to move the outer support plate relative to at least one of the carrier body, the second resilient membrane, and the inner support plate.

According to still yet another aspect, the substrate carrier head further comprises a substrate sensor with a diameter less than or equal to about 0.25 inches.

According to another aspect, the substrate carrier head further comprises a substrate sensor with an adjustable spring force.

According to yet another aspect, the inner plate and the outer plate are substantially coplanar with respect to each other, having a coplanarity of at most about 1 mm.

According to still yet another aspect, at least one of the inner plate and the outer plate comprise a flat surface with a flatness of at most about 0.05 mm.

According to another aspect, the substrate retainer comprises a substantially unbroken outer surface.

Another aspect of the disclosed technology is a chemical mechanical planarization system, comprising the substrate carrier head of any one of the above aspects or embodiments.

All of these embodiments are intended to be within the scope of the invention herein disclosed. These and other embodiments will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

The above, as well as additional objects, features and advantages of the present inventive concept, will be better understood through the following illustrative and non-limiting detailed description of embodiments of the present invention, with reference to the appended drawings. In the drawings like reference numerals will be used for like elements unless stated otherwise.

DETAILED DESCRIPTION OF CERTAIN ILLUSTRATIVE EMBODIMENTS

Figure 1:
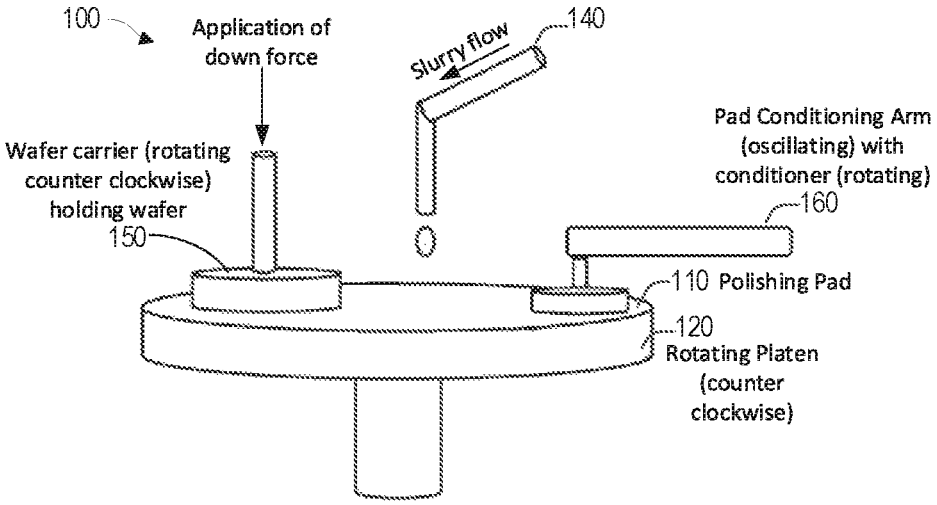
FIG. 1 is a schematic illustration of a substrate processing system, showing a substrate carrier holding a substrate in a processing position.

Although the following text sets forth a detailed description of numerous different embodiments of the invention, it should be understood that the legal scope of the invention is defined by the words of the claims set forth at the end of the patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

Chemical Mechanical Planarization (CMP)

The adoption and use of chemical mechanical planarization (CMP) for the planarization of thin films in the manufacture of semiconductor ICs, MEMS devices, and LEDs, among many other similar applications, is common among companies manufacturing "chips" for these types of devices. This adoption includes the manufacture of chips for mobile telephones, tablets and other portable devices, plus desktop and laptop computers. The growth in nanotechnology and micro-machining holds great promise for ever-widespread use and adaptation of digital devices in the medical field, in the automotive field, and in the Internet of Things (the "IoT"). Chemical mechanical planarization for the planarization of thin films was invented and developed in the early 1980's by scientists and engineers at the IBM Corporation. Today, this process is widespread on a global basis and is one of the truly enabling technologies in the manufacture of many digital devices.

Integrated circuits are manufactured with multiple layers and alternating layers of conducting materials (e.g., copper, tungsten, aluminium, etc.), insulating layers (e.g., silicon dioxide, silicon nitride, etc.), and semiconducting material (e.g., polysilicon). A successive combination of these layers is sequentially applied to the wafer surface, but because of the implanted devices on the surface, topographical undulations are built up upon the device structures, as is the case with silicon dioxide insulator layers. These unwanted topographical undulations are often flattened or "planarized" using CMP, before the next layer can be deposited, to allow for proper interconnect between device features of ever decreasing size. In the case of copper layers, the copper is deposited on the surface to fill contact vias and make effective vertical paths for the transfer of electrons from device to device and from layer to layer. This procedure continues with each layer that is applied (usually applied by a deposition process). In the case of multiple layers of conducting material (multiple layers of metal), this could result in numerous polishing procedures (one for each layer of conductor, insulator, and semiconductor material) in order to achieve successful circuitry and interconnects between device features.

During the CMP process, the substrate or wafer is held by a wafer carrier which is rotated and pressed, generally via a resilient membrane within the wafer carrier, against the polishing platen for a specified period of time. CMP wafer carriers typically incorporate components for precision polishing of generally flat and round workpieces such as silicon wafers and/or films deposited on them on the process head. These components include: 1) the resilient membrane, with compressed gas applied to the top surface or back side of the membrane; said pressure is then transmitted via the membrane to the top surface or back side of the workpiece in order to effect the material removal during CMP; 2) one or more rigid support components which provide means for: fastening the membrane to its mating components, holding the membrane to its desired shape and dimension, and/or clamping the membrane to provide a sealed volume for sealing and containing the controlled gas pressure.

During the process, slurry is applied onto the rotating polishing pad through a fluid control device, such as a metering pump or mass-flow-control regulator system. The slurry can be brought to the polishing platen in a single-pass distribution system. For better performance, the slurry particles in their media should be distributed evenly between the rotating wafer, and the rotating polishing pad/platen.

A force is applied to the backside of the wafer by the wafer carrier membrane to press it into the pad and both may have motion to create a relative velocity. The motion and force leads to portions of the pad creating abrasion by pushing the abrasive against the substrate while it moves across the wafer surface. The corrosive chemicals in the slurry alter the material being polished on the surface of the wafer. This mechanical effect of abrasion combined with chemical alteration is called chemical mechanical planarization or polishing (CMP). The removal rate of the material can be easily an order of magnitude higher with both the chemical and mechanical effects simultaneously compared to either one taken alone. Similarly, the smoothness of the surface after polishing is improved by using chemical and mechanical effects together.

During the polishing process, material such as copper, a dielectric, or polysilicon is removed from the surface of the wafer. These microscopic particles either remain in suspension in the slurry or become embedded in the polishing pad or both. These particles cause scratches on the surface of the film being polished, and thus catastrophic failures in the circuitry rendering the chip useless, thus becoming a major negative effect upon yield.

Yield is the driving force in determining success at the manufacturing level for many products including integrated circuits, MEMS, and LEDs. The surface quality tolerances for a CMP process within semiconductor manufacturing facilities ("fabs") and foundries are measured in nanometers and even Angstroms. The ability to remove material as uniformly as possible from the surface of a wafer or film during CMP is important. Therefore, carrier design technology is constantly evolving toward improving this capability. Small non-uniformities in the flatness of a wafer that has been processed in a CMP system can result in decreased yield and increased waste. Non-uniformities or pressure differentials across the diameters of the wafer carrier and the process pad can cause wafer breakage. The accumulated costs of manufacturing a solid state device are together termed the "Cost-of-Ownership" (CoO) and this term is also applied to each of the required manufacturing steps. The CoO of the CMP process is one of the highest CoO figures in the 500 to 800 individual manufacturing steps required to make a semiconductor "chip" and its associated digital device.

While carrier designs incorporating various embodiments of resilient membrane concepts work well in terms of uniform material removal, there remain some non-optimum characteristics in their typical process performance. Essentially, despite substantial efforts to minimize them, certain practical deficiencies and anomalies still exist, which cause non-uniform pressure application to the wafer and associated non-uniform material removal. Such anomalies include, but are not necessarily limited to: variations in flatness of any rigid components contacting the membrane, and variations in planarization (and thus uniformity) with respect to the center and/or the edge of the wafer, relative to other portions of the wafer, or to each other.

In order to reduce the presence, magnitude and effects of such anomalies, the present application discloses embodiments of an improved substrate carrier for a CMP apparatus. These embodiments improve the flatness tolerances and substrate surface quality, when implemented in a CMP apparatus, and reduced likelihood of wafer breakage, resulting in increased yield and decreased cost of operation. It will be understood that although embodiments of the substrate carriers described herein are disclosed within the context of CMP equipment, they can be similarly implemented within other applications. Additionally, the substrate carrier methods and equipment described herein can be implemented separately, e.g., without the full CMP systems shown. Additionally, other CMP equipment can implement embodiments of the substrate carriers described herein, including multiple-head CMP systems, single head CMP systems, orbital CMP systems, or other CMP systems. For example, the substrate carrier methods and equipment described herein can be implemented within sub-aperture CMP systems. A sub-aperture CMP system can include a polishing pad which is smaller in diameter than the wafer. The wafer is typically oriented face-up with slurry dispensed on its surface, while the wafer and pad are rotated and the pad sweeps across the wafer.

The disclosed technology will be described with respect to particular embodiments and with reference to certain drawings. The disclosure is not limited thereto but only by the claims. The drawings described are only schematic and are non-limiting. In the drawings, the size of some of the elements may be exaggerated and not drawn to scale for illustrative purposes. The dimensions and the relative dimensions do not necessarily correspond to actual reductions to practice of the disclosure.

FIG. 1 is a schematic illustration of a chemical mechanical planarization system 100 for treating a polishing pad 110. System 100 can include a wafer carrier 150 configured to hold and process a wafer. It will be understood that the term "wafer" as used herein may refer to a circular, semiconductor wafer, but can more broadly encompass other types of substrates with different shapes which are processed by polishing or planarizing equipment, such as CMP equipment. In the illustrated embodiment, the wafer carrier 150 is in a processing (e.g., lower) position, holding the wafer (not shown) against a polishing pad 110 with a membrane (not shown). The polishing pad 110 can be positioned on a supporting surface, such as a surface of a platen 120.

Figure 2:
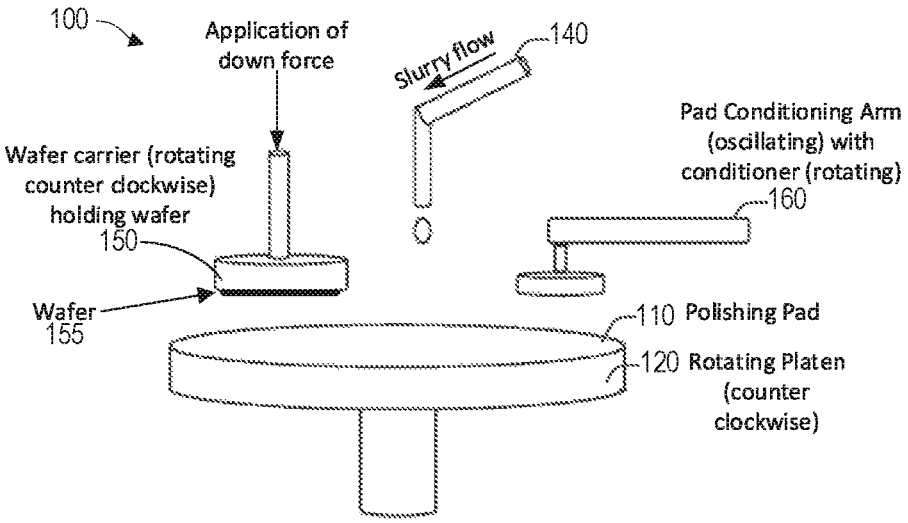
FIG. 2 is a view of the substrate processing system of FIG. 1, showing the substrate carrier holding the substrate in a loading position.

FIG. 2 is a view of the chemical mechanical planarization system of FIG. 1, showing a wafer 155 held by the wafer carrier 150 in a loading (e.g., upper) position. The wafer 155 can be held, for example, by force of a vacuum. Referring to both FIGS. 1 and 2, system 100 can include a slurry delivery system 140 configured to deliver the processing slurry to the wafer 155, and allow it to be chemically/mechanically planarized against the polishing pad 110. System 100 can include a pad conditioning arm 160, which includes a pad conditioner at its end, which can be configured to treat or "refresh" the surface roughness, or other processing characteristics of the pad, during or between processing cycles.

In the system 100 of FIGS. 1 and 2, polishing pad 110 is on the top surface of platen 120 which rotates counter clockwise about a vertical axis. Other orientations and directions of movement can be implemented.

The slurry delivery system 140 can deliver a slurry containing abrasive and corrosive particles to a surface of the treated polishing pad 130. The polishing slurries are typically colloidal suspensions of abrasive particles, i.e. colloidal silica, colloidal alumina, or colloidal ceria, in a water based medium. In various embodiments, the slurry delivery system 140 includes a metering pump, mass-flow-control regulator system, or other suitable fluid delivery components.

The wafer carrier 150 can hold wafer 155, for example, with a vacuum, so that the surface of the wafer 155 to be polished faces towards polishing pad 110. Abrasive particles and corrosive chemicals in the slurry deposited by the slurry delivery system 140 on the polishing pad 110 mechanically and chemically polish the wafer through abrasion and corrosion, respectively. The wafer carrier 155 and polishing pad 110 can move relative to each other in any of a number of different ways, to provide the polishing. For example, the wafer carrier 150 can apply a downward force against the platen 120 so that the wafer 155 is pressed against the polishing pad 110. The wafer 155 can be pressed against the polishing pad 110 with a pressurized membrane (not shown), as will be described further herein. Abrasive particles and corrosive chemicals of the slurry between the wafer 155 and the polishing pad 110 can provide chemical and mechanical polishing as the polishing pad 110 and wafer carrier 155 move relative to each other. The relative motion between polishing pads and wafer carriers can be configured in various ways, and either or both can be configured to oscillate, move linearly, and/or rotate, counter clockwise and/or clockwise relative to each other.

Pad conditioning arm 160 can condition the surface of polishing pad 110, by pressing against polishing pad 110 with a force, with relative movement therebetween, such as the relative motion described above with respect to the polishing pad and wafer carrier 150. The pad conditioning arm 160 in the illustrated embodiment can oscillate, with a rotating pad conditioner at its end, which contacts the polishing pad 110.

Figure 3:
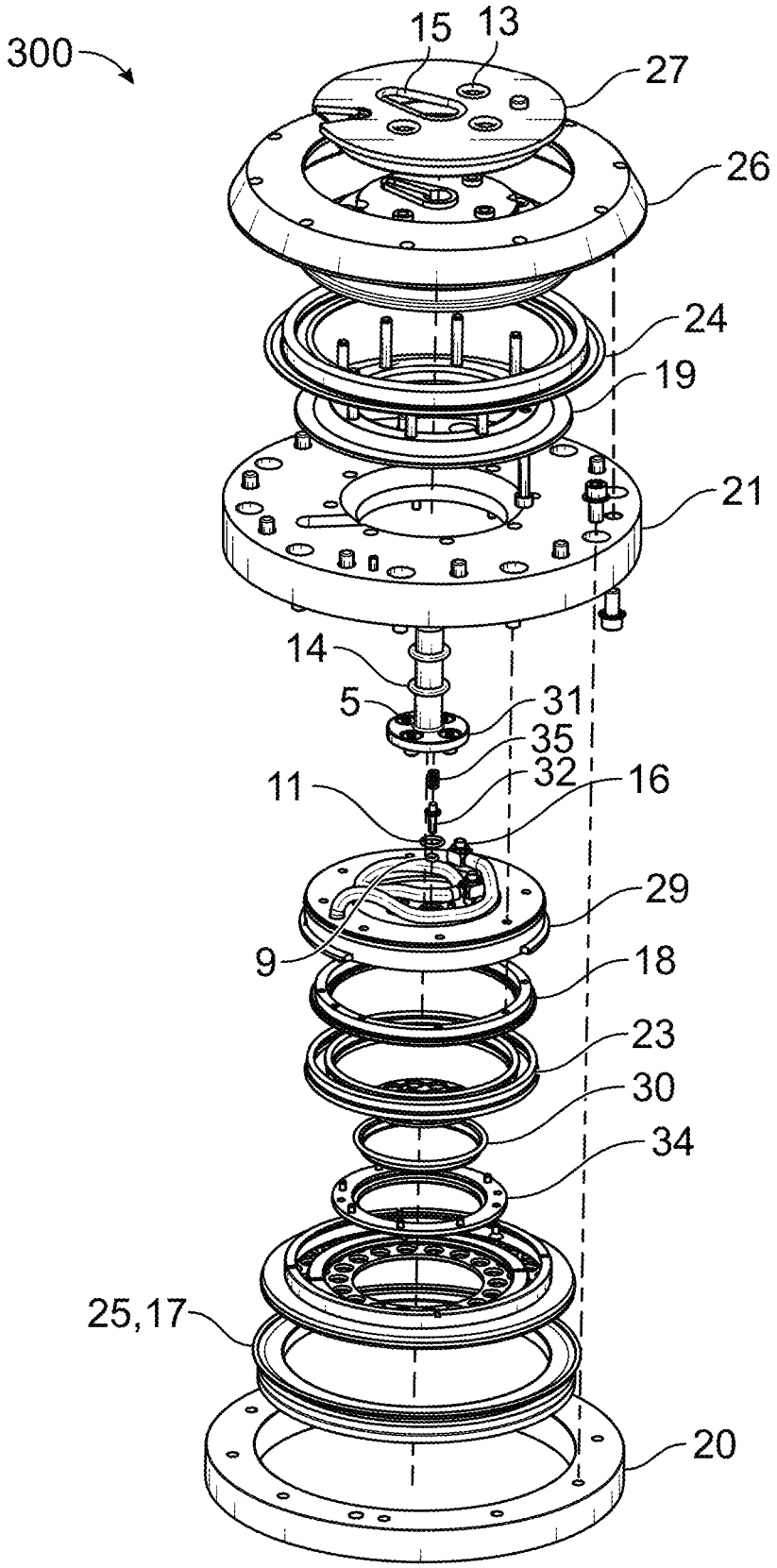
FIG. 3 is an exploded top isometric view of an embodiment of a carrier head.
Figure 4:
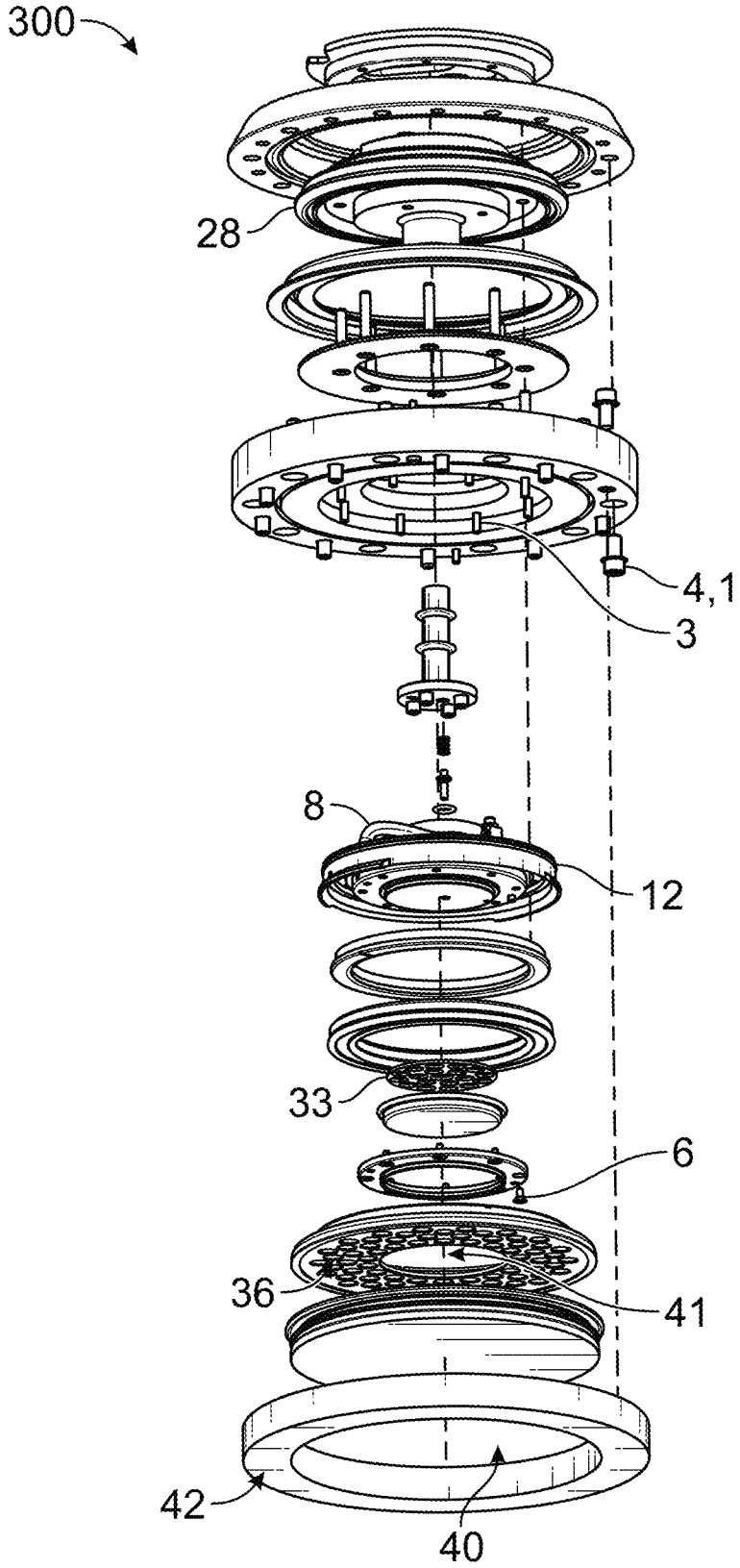
FIG. 4 is an exploded bottom isometric view of the carrier head in FIG. 3.
Figure 5:
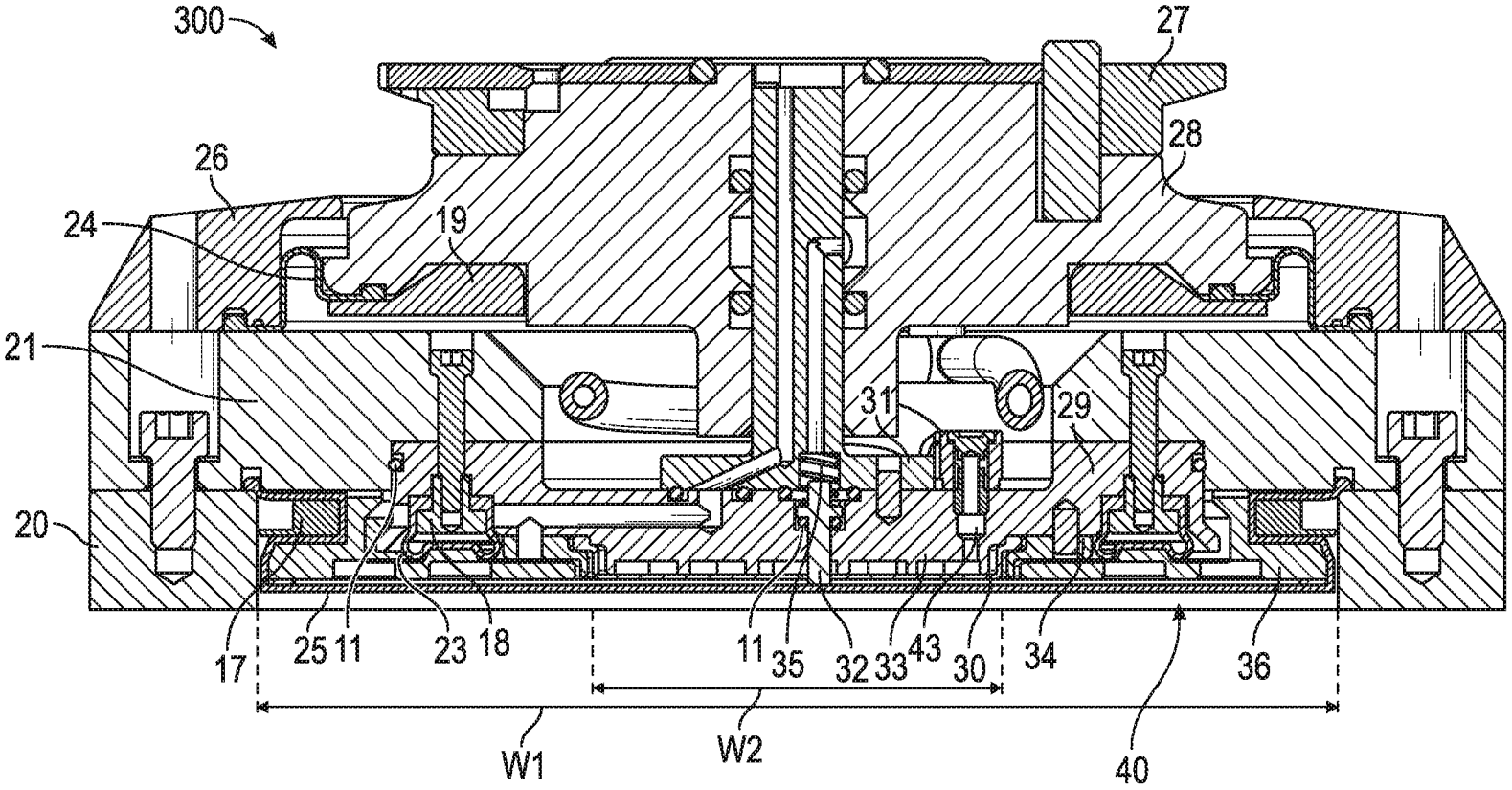
FIG. 5 is a cross-sectional view of the carrier head in FIG. 3.

FIG. 3 is an exploded top isometric view of an embodiment of a substrate carrier head 300. FIG. 4 is an exploded bottom isometric view of the carrier head 300 in FIG. 3. FIG. 5 is a cross-sectional view of the carrier head 300 in FIG. 3. Embodiments of carrier head 300 can be implemented within various types of substrate processing apparatus. For example, the carrier head 300 can be implemented in CMP systems, such as those described with reference to FIGS. 1 and 2, or other types of CMP systems.

With reference to one or more of FIGS. 3-5, the substrate carrier head 300 can include a carrier body 21 to support various components of the carrier head 300. The carrier head can include a substrate retainer 20 attached to the carrier body 21. The retainer 20 can be configured to retain and support a substrate on the carrier head 300. For example, the substrate retainer can include an aperture 40 configured to receive a substrate. The aperture 40 can form sidewalls extending partially or completely through the thickness of the substrate retainer to support, and thus prevent lateral movement, of a substrate held within aperture 40. The retainer 20 can be a separate or integrally formed piece and can be the same or different material, with respect to the carrier body 21. The substrate retainer can include a substantially unbroken outer surface 42, or the surface can have grooves or other recesses to improve slurry flow.

The carrier head 300 can include a first resilient membrane 25 and a second resilient membrane 30. The membranes, or portions thereof, can be stacked or positioned adjacent to each other, for example without intervening structure. The membranes 25, 30 can together press a substrate against a substrate processing platen during substrate processing, as described above with respect to CMP processing in FIGS. 1 and 2. Portions of membranes 25, 30 can press against each other.

The membranes may be flexible such that each conforms to an adjacent structure. The membrane material may be any resilient material, for example, material suitable for receiving a back pressure, and transferring that back pressure against a substrate held within a carrier head. In some embodiments, the membrane material may be one of rubber or a synthetic rubber material. The membrane material may also be one of Ethylene propylene diene monomer (M-class) (EPDM) rubber or silicone. Alternatively, it may be one or more combinations of vinyl, rubber, silicone rubber, synthetic rubber, nitrile, thermoplastic elastomer, fluorelastomers, hydrated acrylonitrile butadiene rubber, or urethane and polyurethane formas.

The membranes 25, 30 can include portions that provide support to a substrate held within carrier 300. Such substrate support portions can be distinguished from other portions of the membranes which do not support the substrate, but assist in attaching the membranes to other portions of the carrier.

For example, the first resilient membrane 25 can include a first substrate support portion with a width W1 as shown. The first substrate support portion as shown is the horizontal portion of first membrane 25 which extends and provides support across its width W1 to a substrate held within the aperture 40 of the substrate retainer 20. The remainder of the first resilient membrane 25 (i.e., the portions that are not the first substrate support portion), which can include, for example, the shorter vertical and horizontal portions wrapping in a serpentine shape around and/or between an outer portion of an outer support plate 36 (described further below), a membrane backing support 17, the substrate retainer 20 and the carrier body 21, can be configured to provide attachment of the first membrane 25 to the rest of the carrier head 300.

The second resilient membrane 30 can include a second substrate support portion with a width W2. The second substrate support portion as shown is the horizontal portion of second membrane 30 which extends and provides support across its width W2 to an inner, central portion of a substrate held within the aperture 40 of the substrate retainer 20. The second substrate support portion can be positioned between the first substrate support portion and the carrier body 21. The first and second substrate support portions can be stacked with respect to each other, and can be stacked directly on each other (i.e., contacting each other). The second substrate portion can be stacked above the first substrate portion, in the orientation shown. The second substrate support portion can be configured to selectively provide a force against an inner section of the first imperforated substrate support portion as shown. An outer surface of the second substrate support portion can directly contact an inner surface of at least the inner section of the first substrate support portion. This configuration can allow the second membrane 30 to provide improved process and uniformity on a substrate, for example, to provide improved center removal rate control in a CMP process.

The remainder of the second resilient membrane 30 (relative to the second substrate support portion), which can include, for example, the short vertical portion at its outer edges, and the horizontal lip extending from the distal end of the vertical portion, can be configured to provide attachment of the second membrane 30 to the rest of the carrier head 300.

The membranes 25, 30 can each include imperforated portion(s), or the membranes 25, 30 can each be substantially entirely imperforated. The membranes 25, 30, or sections thereof, can be imperforated, to allow for expansion and contraction of the membranes using pressure or vacuum, during processing. Thus, such as the first and second substrate support portions can each be imperforated to form a first imperforated substrate support portion, and a second imperforated substrate support portion, respectively.

The carrier head can include an inner support plate 33. The inner support plate can be fixed, to prevent relative motion, once assembled, relative to the carrier body 21. The inner support plate 33 can include a generally planar, rigid support surface configured to support a substrate held upon the second substrate support portion of the second membrane 30 during processing.

The carrier can include an outer support plate 36. The outer support plate 36 can include a generally planar, rigid support surface configured to support a substrate held upon the first substrate support portion of the first membrane 25. In some embodiments, the outer support plate 36 can support a section of the first substrate support portion of the first membrane 25. For example, the outer support plate 36 can include a central opening 41 surrounded by an outer plate portion which can support a corresponding outer section of the first substrate support portion of the second membrane 30 during processing. The central opening 41 can be configured to surround the second substrate support portion. In some embodiments, the width W1 of the first substrate support portion can be greater than the width W2 of the second substrate support portion. In some embodiments, the outer support plate 36, first membrane 25, and second membrane 30 can be configured such that the second substrate support portion can pass through the central opening 41 of the outer support plate 36. Thus, in some embodiments, the inner support plate 33 can support an inner portion of a substrate held upon the carrier 300, and the outer support plate 36 can support an outer portion of a substrate held upon the carrier 300, during processing.

The membranes herein may be single, or multi-zoned membranes. For example, the membranes may have grooves (e.g., indentations) and/or raised portions that effectively segregate various zones within each of the membranes. In a non-limiting example, the grooves may be arranged in a series of concentric circles originating from the center of the membrane. In another example, the grooves and raised portions may be irregularly shaped (e.g., interconnecting circles, non-circular indentations, circular patterns scattered across the surface of the membrane) in order to improve distribution of pressure applied across the substrate during processing.

In some embodiments, either or both membranes can be a single zone membrane wherein each zone is configured to receive pressure or vacuum from only a single cavity on the backside of each membrane. "Single cavity" is defined as a single volume in common fluid communication, and not be limited to a particular shape. The cavity can comprise a small volume in common fluid communication, which is formed between relatively small tolerances between components, without being readily viewable on FIG. 5. For example, carrier 300 can include a single first membrane cavity formed within relatively small open spaces between the first substrate support portion of the first membrane 25 and portions of the carrier body 21 and/or the outer support plate 36. The first membrane cavity can provide fluid communication from a vacuum or pressure source to the backside of the first substrate support portion of the first membrane 25. In some embodiments, carrier 300 can include a single second membrane cavity formed, for example, between the second substrate support portion of the second membrane 30 and the inner support plate 33. The first and/or second cavities can increase in volume upon pressurization of the corresponding first and second membranes 25, 30.

In some embodiments, the cavities can comprise a portion of the volume formed by the vacuum/pressure source to the membranes 25, 30, and/or any holes in the corresponding plates 33, 36. For example, the second membrane 30 can, in a non-pressurized and non-vacuum state (quiescent state), be in direct contact with the inner support plate 33. Under such a scenario, the carrier still includes a cavity which provides backpressure (or vacuum) to the second membrane 30, via the aforementioned small tolerancing between components, the volume within the pressure/vacuum supply, and/or the holes in plate 33. The second membrane cavity can provide fluid communication from a vacuum or pressure source to the backside of the second substrate support portion of the second membrane 30. In some embodiments, carrier 300 can include only the first and second single membrane cavities, with only the first and second substrate support portions of only the first membrane 25 and the second membrane 30.

In some embodiments, at least one of the outer support plate 36 and the inner support plate 33 can include a plurality of holes, as shown. The holes can be configured to extend through a thickness of the outer support plate and/or the inner support plate. The plurality of holes can include a plurality of holes extending through the thickness of the outer support plate 36. The plurality of holes can include a plurality of holes extending through the thickness of the inner support plate.

Figure 7:
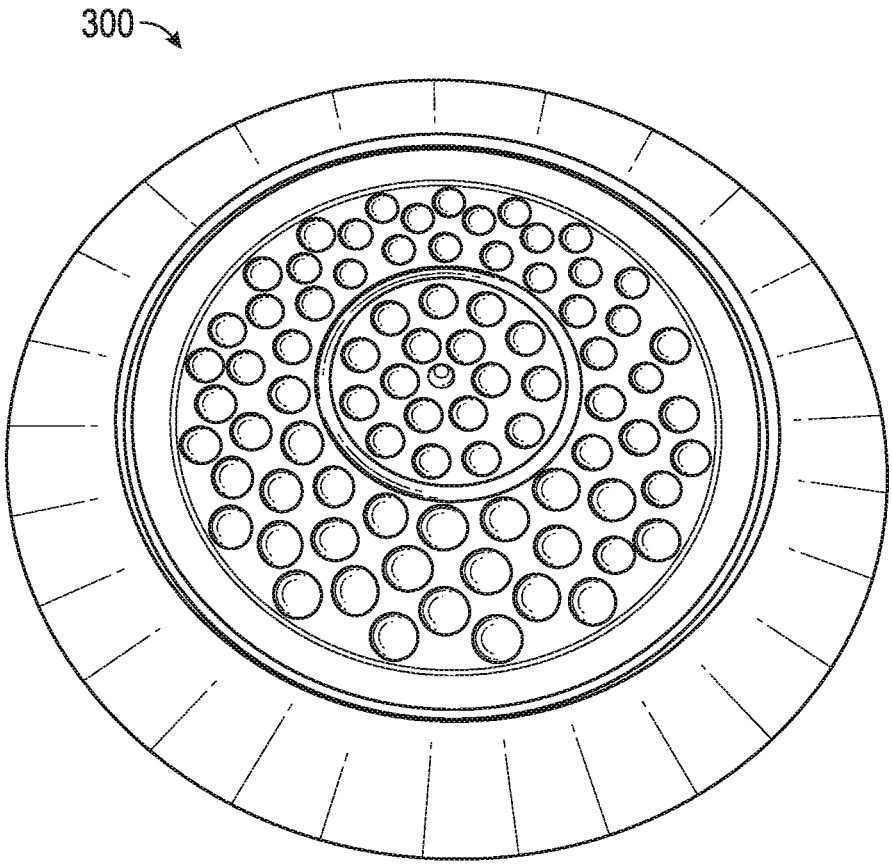
FIG. 7 is a lower isometric view showing the carrier head in FIGS. 3-6 in a vacuum state.

The holes can provide fluid communication between a vacuum and/or pressure source and the backside of membranes 25 and 30. For example, the plurality of holes can provide fluid communication between the first cavity and the backside of the first substrate support portion. The plurality of holes can provide fluid communication between the second cavity and the backside of the second substrate support portion. In the embodiments that include the first and second membrane cavities, the holes can allow fluid communication between the first membrane cavity and the backside of membrane 25, and between the second membrane cavity and the backside of membrane 30. When subjected to vacuum, the corresponding substrate support portions of membranes 25 and/or 30 can be pulled at least partially into the corresponding plurality of holes, to form corresponding dimples in the membranes, as show in FIG. 7. Such dimples can provide a suction cup effect to hold a substrate on the substrate support portion of the membrane 25 within carrier 300. Providing pressure or releasing vacuum to the membranes 25 and/or 30 can allow a substrate to be released from carrier 300.

The size and/or shape of the holes can be selected to reduce substrate breakage and improve uniformity. Each of the plurality of holes can be the same or different shapes or sizes relative to each other. One or more of the holes can be round. As shown for illustrative purposes, each of the plurality of holes are round, and each are the same diameter relative to each other. In some embodiments, the holes can be sized at or below a threshold, to reduce substrate breakage during processing. For example, each of the plurality of holes can be sized to have an area less than, or less than or equal to about: 0.43 $in^2$, 0.4 $in^2$, 0.3 $in^2$, 0.2 $in^2$, 0.15 $in^2$, 0.07 $in^2$, or 0.05 $in^2$ or any range therebetween that reduces substrate breakage relative to holes with an area greater than or equal to 0.44 $in^2$, while still being large enough to provide the suction cup effect while under vacuum, as described elsewhere herein. In some embodiments, each of the plurality of holes are round, with a diameter less than, or less than or equal to about: 0.74 in, 0.7 in, 0.6 in, 0.5 in, 0.4 in, 0.3 in, 0.25 in, or any range therebetween that reduces substrate breakage relative to round holes with a diameter greater than or equal to 0.75 $in^2$, while still being large enough to provide the suction cup effect while under vacuum, as described elsewhere herein.

In some embodiments, the plurality of holes can include a center hole extending through a center of the inner support plate 33. The center hole can be the same cross-sectional area as at least one of the other plurality of holes extending through the inner support plate 33.

The carrier 300 can include a substrate sensor 32 configured to detect whether a substrate is held within carrier 300. The sensor 32 can comprise an adjustable spring, such that sensor 32 has an adjustable spring force. Thus, the amount of force that sensor 32 imparts upon a substrate held within carrier 300, can be adjusted below a desired threshold, to reduce the probability of substrate damage. In some embodiments, the cross sectional area of the sensor 32 can be sized at or below a threshold, to reduce substrate breakage during processing. In some embodiments, the sensor 32 can be sized to have a diameter less than, or less than or equal to about: 0.25 in, 0.19 in, 0.13 in, 0.094 in, 0.063 in, or any corresponding cross sectional area (regardless of shape), or any range therebetween, that reduces substrate breakage relative to a sensor with a larger diameter, while still being capable of providing said sensing functionality.

Figure 6:
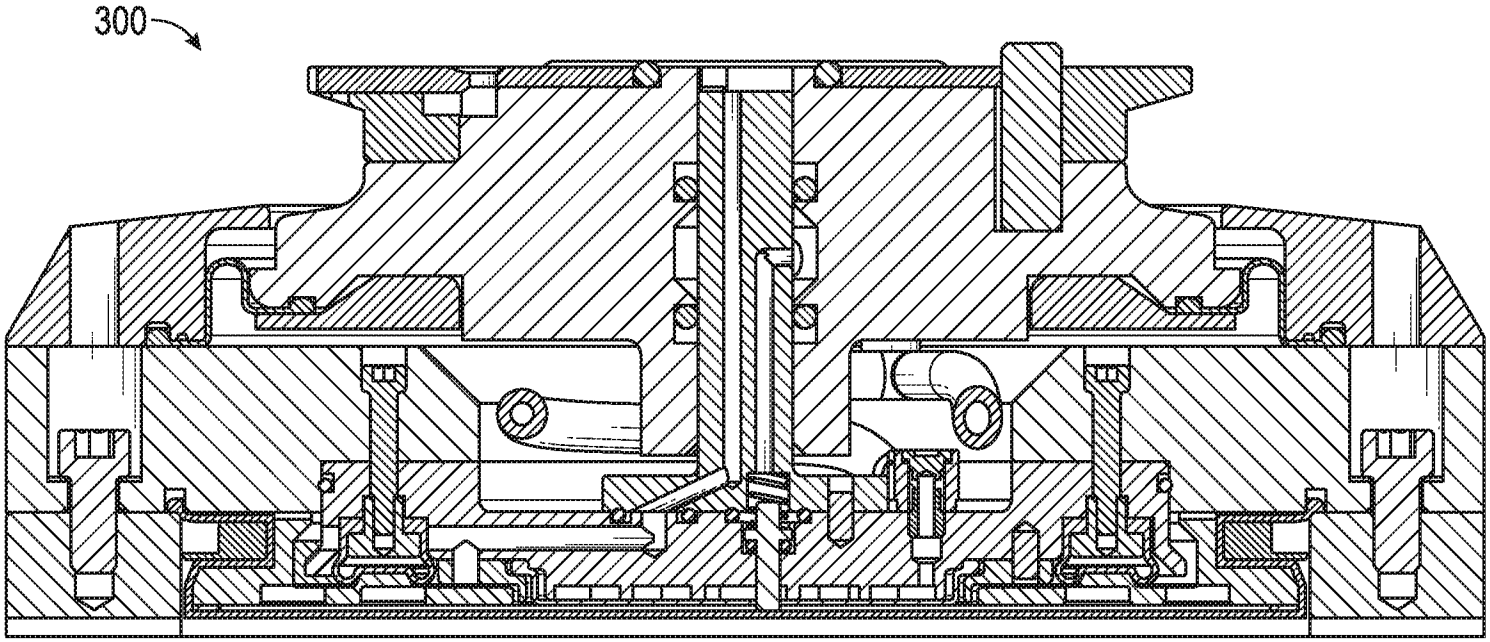
FIG. 6 is another cross-sectional view showing co-planarity between components of the carrier head in FIG. 3.

FIG. 6 is a cross-sectional view showing co-planarity between components of the carrier head 300 in FIGS. 3-5. Referring to one or more of FIG. 3-6, in some embodiments, the carrier 300 can be configured to allow relative movement (and thus relative positioning) between the outer support plate 36 and at least one of the carrier body 21, the second resilient membrane 30, and the inner support plate 33. Such embodiments can allow the inner plate 33 and the outer plate 36 to be substantially coplanar with respect to each other. Such coplanarity can be implemented during processing, to reduce non-uniform forces on a substrate, and reduce substrate breakage. In some embodiments, the inner plate 33 and the outer plate 36 can be substantially coplanar with respect to each other within a range between substantially 0 mm and 1 mm, approximately 0.001 mm and 1 mm, for example at most about 1 mm. In some embodiments, the flatness of the inner plate 33 and the outer plate 36 can range between substantially 0 mm and 0.1 mm, approximately 0.0005 mm and 0.1 mm, for example, at most about 0.1 mm, or at most about 0.05 mm.

The aforementioned relative movement and positioning between the outer support plate 36 and at least one of the carrier body 21, the second resilient membrane 30, and the inner support plate 33 can be provided in different ways. For example, the outer support plate 36 can be engaged with a bladder 23, which is attached to body 21 with a bladder retainer 18. Bladder 23 can receive vacuum or pressure from a vacuum or pressure source, to move outer support plate 36 relative to one or more of carrier body 21, second resilient membrane 30, and the inner support plate 33. Bladder 23 can move outer support plate 23 through direct contact therebetween, or through intervening support structure.

The carrier body 21 can be supported by additional support structure, for interfacing carrier head 300 with the remainder of a substrate processing tool. For example, carrier body 21 can be attached to a mounting base 27 that allows carrier head 300 to mount to the remainder of a substrate processing tool. The carrier head 300 can be configured to allow relative movement between the carrier body 21 and the mounting base 27. For example, carrier head 300 can include a rolling diaphragm 24, which can receive pressure or vacuum from a pressure or vacuum source, to provide said relative movement. The rolling diaphragm 24 can be supported in different ways. For example, an outer diaphragm support 26 can secure an outer portion of the diaphragm 24 to the body 21, and an inner portion of the diaphragm 24 can be secured between a first inner diaphragm support 28 and a second inner diaphragm support 19.

The pressure and/or vacuum sources (not shown) that can provide pressure and/or vacuum to one or more of the first substrate support portion, the second substrate support portion, the bladder 18, and the diaphragm 24 can be implemented in different ways. For example, the carrier 300 can include manifold(s), fitting(s), tubing, piping, channels, or other components, to provide pressure/vacuum as described herein. For example, the base 27, support 28, a central shaft 31, or other components, can provide the fluid communication described herein.

Carrier 300 can include any of a number of different mechanical components, for providing attachment, sealing, and other typical functionality between different components of carrier 300. For example, the figures show for illustrative purposes only, and without limitation to the exact configuration and quantities shown, lock washers 1, screws 2, 3, 4, 5, 6, dowel pin 7, tubing 8, o-rings 9-15, fitting 16, indexing pin 22, and other unnumbered components. Fitting 43 is provided to facilitate flow from a pressure/vacuum source to the backside of membrane 30, as shown in FIG. 5.

The word "exemplary" is used herein to mean "serving as an example, instance, or illustration." Any aspect or embodiment described herein as "exemplary" is not necessarily to be construed as preferred or advantageous over other aspects or embodiments. Various aspects of the novel systems, apparatuses, and methods are described more fully hereinafter with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the novel systems, apparatuses, and methods disclosed herein, whether implemented independently of, or combined with, any other aspect described. For example, an apparatus may be implemented or a method may be practiced using any number of the aspects set forth herein. In addition, the scope of the disclosure is intended to cover such an apparatus or method which is practiced using other structure, functionality, or structure and functionality in addition to or other than the various aspects of the disclosures set forth herein. It should be understood that any aspect disclosed herein may be embodied by one or more elements of a claim.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount, depending on the desired function or desired result.

While certain embodiments have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products. For example, any of the components for an energy storage system described herein can be provided separately, or integrated together (e.g., packaged together, or attached together) to form an energy storage system.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

The headings provided herein, if any, are for convenience only and do not necessarily affect the scope or meaning of the devices and methods disclosed herein.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A substrate carrier head comprising:

a carrier body;

a substrate retainer attached to the carrier body, the substrate retainer comprising an aperture configured to receive a substrate;

a first resilient membrane comprising a first imperforated substrate support portion with a width W1;

a second resilient membrane comprising a second imperforated substrate support portion with a width W2, the second imperforated substrate support portion positioned between the first substrate support portion and the carrier body and configured to selectively provide a force against at least an inner section of the first imperforated substrate support portion; and an inner support plate fixed relative to the carrier body to prevent relative motion of the inner support plate relative to the carrier body, the inner support plate comprising a support surface configured to support a substrate held upon the second imperforated substrate support portion.

2. The substrate carrier head of claim 1, wherein W1 is greater than W2.

3. The substrate carrier head of claim 1, further comprising a single first membrane cavity formed between the first substrate support portion and the carrier body.

4. The substrate carrier head of claim 1, further comprising a single second membrane cavity formed between the second substrate support portion and the inner support plate.

5. The substrate carrier head of claim 1, further comprising an outer support plate configured to support an outer section of the first substrate support portion.

6. The substrate carrier head of claim 5, wherein the outer support plate comprises a central opening configured to surround the second substrate support portion.

7. The substrate carrier head of claim 6, wherein the outer support plate, first membrane, and second membrane are configured such that the second substrate support portion can pass through the central opening.

8. The substrate carrier head of claim 5, wherein at least one of the outer support plate and the inner support plate comprise a plurality of holes configured to extend through a thickness of the at least one of the outer support plate and the inner support plate, and to provide fluid communication between at least one of the first cavity and the first substrate support portion and the second cavity and the second substrate support portion.

9. The substrate carrier head of claim 8, wherein the plurality of holes comprises a first plurality of holes extending through the thickness of the outer support plate, and a second plurality of holes extending through the thickness of the inner support plate.

10. The substrate carrier head of claim 9, wherein the second plurality of holes comprises a center hole extending through the center of the inner support plate, wherein the center hole is the same cross-sectional area as at least one of the other plurality of holes.

11. The substrate carrier head of claim 8, wherein each of the plurality of holes are round, and the same diameter relative to each other.

12. The substrate carrier head of claim 8, wherein each of the plurality of holes has an area less than about 0.4 $in^2$.

13. The substrate carrier head of claim 1, wherein the second substrate support portion directly contacts at least the inner section of the first substrate support portion.

14. The substrate carrier head of claim 5, further comprising a bladder configured to move the outer support plate relative to at least one of the carrier body, the second resilient membrane, and the inner support plate.

15. The substrate carrier head of claim 1, further comprising a substrate sensor with a diameter less than or equal to about 0.25 inches.

16. The substrate carrier head of claim 1, further comprising a substrate sensor with an adjustable spring force.

17. The substrate carrier head of claim 5, wherein the inner plate and the outer plate are substantially coplanar with respect to each other, having a coplanarity of at most about 1 mm.

18. The substrate carrier head of claim 5, wherein at least one of the inner plate and the outer plate comprise a flat surface with a flatness of at most about 0.05 mm.

19. The substrate carrier head of claim 1, wherein the substrate retainer comprises a substantially unbroken outer surface.

20. A chemical mechanical planarization system, comprising:

a rotating platen including a polishing pad;

a slurry delivery system;

a pad condition arm; and a substrate carrier head comprising:

a carrier body;

a substrate retainer attached to the carrier body, the substrate retainer comprising an aperture configured to receive a substrate;

a first resilient membrane comprising a first imperforated substrate support portion with a width W1;

a second resilient membrane comprising a second imperforated substrate support portion with a width W2, the second imperforated substrate support portion positioned between the first substrate support portion and the carrier body and configured to selectively provide a force against at least an inner section of the first imperforated substrate support portion; and an inner support plate fixed relative to the carrier body to prevent relative motion of the inner support plate relative to the carrier body, the inner support plate comprising a support surface configured to support a substrate held upon the second imperforated substrate support portion.

* * * * *